United States Patent [19]

Kume et al.

[11] 4,274,153

[45] Jun. 16, 1981

[54] MOVEMENT CONSTRUCTION FOR ELECTRONIC TIMEPIECE

[75] Inventors: Kazunari Kume; Minoru Watanabe, both of Tokorozawa; Hideshi Ohno, Sayama; Munetaka Tamaru, Tokyo, all of Japan

[73] Assignee: Citizen Watch Company Limited, Tokyo, Japan

[21] Appl. No.: 948,591

[22] Filed: Oct. 4, 1978

Related U.S. Application Data

[63] Continuation-in-part of Ser. No. 787,410, Apr. 14, 1977, abandoned.

[30] Foreign Application Priority Data

Apr. 30, 1976 [JP] Japan ..... 51-49544

[51] Int. Cl.[3] ..... G04B 19/04

[52] U.S. Cl. ..... 368/80; 368/220

[58] Field of Search ..... 58/23 D, 23 BA, 59, 58/104, 106.5, 125 R, 138, 139, 140 R, 52 R, 7; 368/76, 80, 88, 220, 228

[56] References Cited

U.S. PATENT DOCUMENTS

| | | | |
|---|---|---|---|
| 3,977,176 | 8/1976 | Murakami et al. | 58/23 BA |
| 4,033,111 | 7/1977 | Matsuura | 58/106.5 |
| 4,087,957 | 5/1978 | Miyasaka et al. | 58/104 |
| 4,127,984 | 12/1978 | Ogihara et al. | 58/7 |

*Primary Examiner*—Vit W. Miska

*Attorney, Agent, or Firm*—Jordan and Hamburg

[57] ABSTRACT

A movement structure for an electronic timepiece, in which a wheel train of a time indicating mechanism is supported between a wheel train bridge and a base plate. The base plate carries thereon a stepping motor connected to the time indicating mechanism, and the wheel train bridge carries thereon an integrated circuit chip.

15 Claims, 25 Drawing Figures

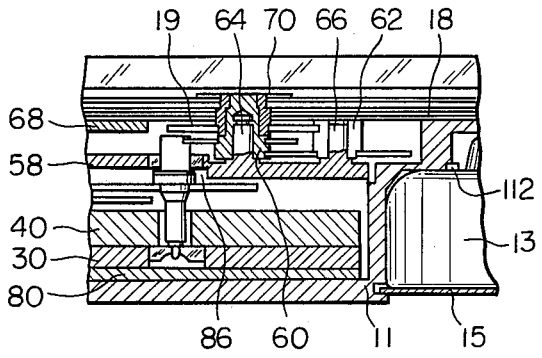
Fig. 7
Fig. 8A
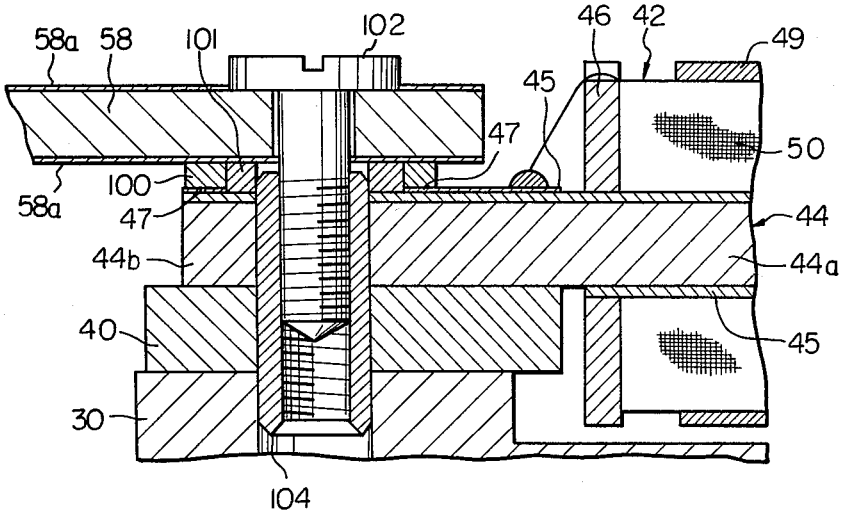
Fig. 8B
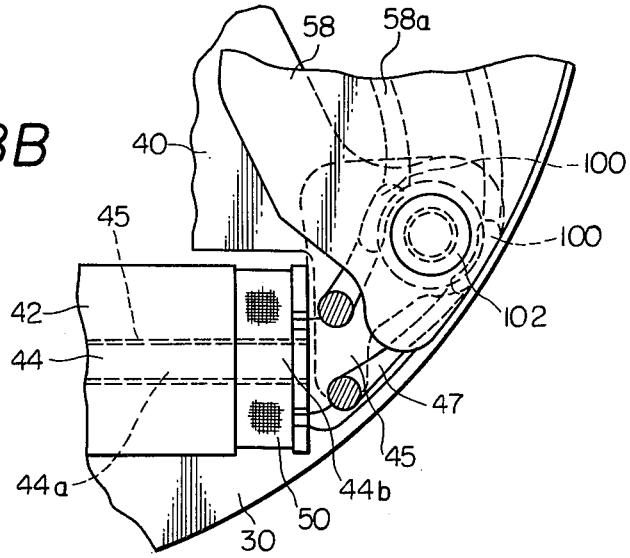

MOVEMENT CONSTRUCTION FOR ELECTRONIC TIMEPIECE

This application is a continuation in part of patent application Ser. No. 787,410 filed Apr. 14, 1977, now abandoned.

This invention relates to a movement structure for an electronic timepiece.

In a conventional structure for providing a connection between the coil terminal of a driving coil and the output terminal of a circuit, the connection is accomplished by using a spring to bring into contact a coil connection spring fixed to a circuit board and a coil terminal seat fixed to the core of the driving coil by means of an adhesive or the like. However, since the connection is afforded due to the contact provided by the coil contact spring, problems are experienced wherein the coil contact spring is deformed whenever the timepiece is subject to an impact resulting from a fall or similar cause, thereby rendering a poor connection. Moreover, the structure of the connection is complicated due to the requirement for such parts as rivets to fix the coil connections spring to the circuit board and the coil terminal seat which is fixed to the coil core. These parts also require a large amount of space and it is difficult to attain a compact, slender timepiece.

It is, therefore, an object of the present invention to obviate these derects and provide a structure for a connection terminal which is simple and reliable. To achieve these objectives a connection terminal structure is adopted in which the connection between the coil terminal and output terminal is effected through the intermediary of a strip of electrically conductive rubber which is locally conductive only between opposing electrodes.

It is another object of the present invention to provide an electronic timepiece which is slenderer, more compact, has fewer parts and possesses the following features: the base plate utilized in the timepiece also serves as a supporting plate for the stators; the stator supporting plate is joined to the stators by a spot welding or similar method; an IC circuit and a quartz oscillator are integrated with a wheel train bridge; the shafts which support the hour hand, minute hand and minute wheel are mounted to the wheel train bridge; a wheel pinion passing through the wheel train bridge is supported by a bearing; an upper shielding plate disposed adjacent the upper face of the wheel train bridge is positioned by a shaft or pin formed by a coining process; a thin dial (having a thickness of 100 microns according to the present embodiment) is employed and, without the provision of a dial base pillar, is positioned by a shaft or pin formed by a coining process; thin, flexible disks are employed as the hands of the timepiece so that the hands may slide upon the dial or upon each other; the back cover of the timepiece extends up to the vicinity of the dial so that the compartments which house the battery and timepiece components are completely isolated from each other; the upper surface of the back cover seats either the dial or an upper shielding plate; the upper surface of the back cover provides direct support for flexure of the wheel train bridge when the bridge is subjected to an external force (such as when the hands are attached); the wheel train bridge is directly fastened to the back cover by means of screws; a packing which assures a water- and dust-proof condition is inserted between the timepiece case and back cover and arranged in three dimensions; a hole bored through the wall separating the battery compartment from the interior of the timepiece is provided with an electrically conductive member and sealed with a resin (which in the present embodiment is silicon rubber); the battery partially extends beyond the rim of the back cover and is protected by the case; retention of the battery is accomplished by means of a thin, flexible plate (a battery cap spring) provided with detents; the battery cap spring serves to join the case to the back cover; the width to thickness ratio of a coil core is increased; an electronic hand setting system is adopted so that such components as setting wheels and setting lever springs can be eliminated; a push-type switch mechanism is adopted so that a winding stem can be eliminated; the switch structure is simplified by making use of a piece of electrically conductive rubber in the push-type switch mechanism; and the electrically conductive rubber member is adapted to serve as a water proofing and duct proofing function.

These and other objects and features of the present invention will become more apparent from the following description when taken in conjunction with the accompanying drawings, in which:

FIGS. 7, 8A, 8B and 9 are fragmentary views of the movement shown in FIG. 4;

Figure 1:
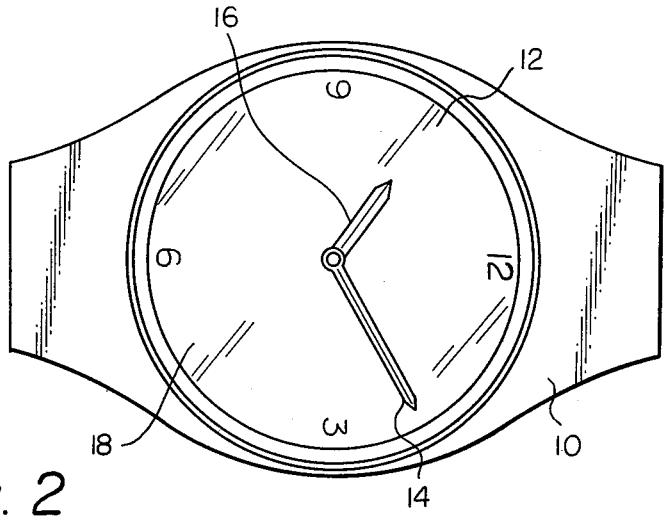
FIG. 1 is a plan view of a wristwatch according to the present invention.
Figure 2:
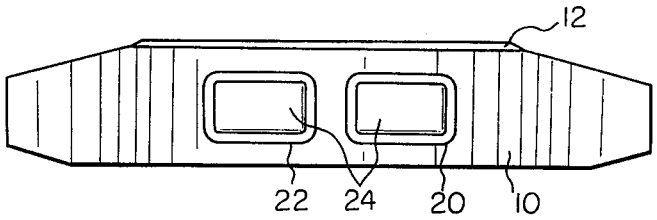
FIG. 2 is a side view of the wristwatch shown in FIG. 1.
Figure 3:
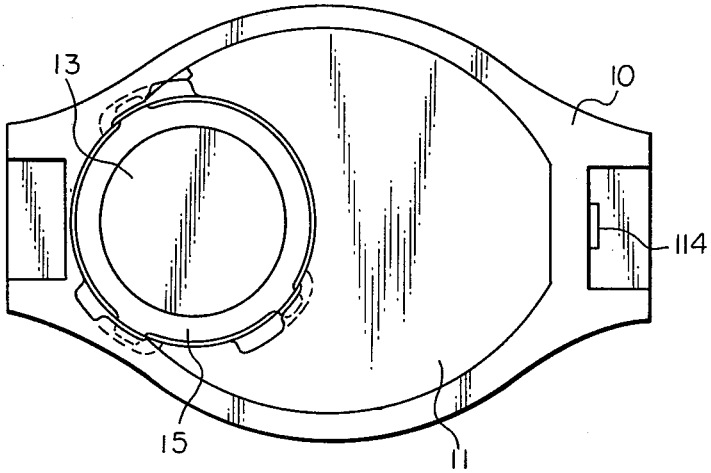
FIG. 3 is a bottom view of the wristwatch shown in FIG. 1.

In FIGS. 1 and 2, there is fixed to a watchcase 10 a transparent watchglass 12 through which the time is indicated by a minute hand 14, an hour hand 16 and a dial 18. Opened at the side of watchcase 10 are switch windows 20, 22 which allow the hands of the watch to be set and through which is visible a single electrically conductive rubber strip 24 adapted to provide a switching function.

The timepiece according to the present embodiment is a quartz timepiece equipped with two hands and a quartz oscillator as the time standard and is so constructed that minute hand 14 advances through one-sixth of the interval between minute graduations every 10 seconds. To set the hands of the timepiece and perform time corrections the conductive rubber strip is depressed through window 20 to set the hands back and through window 22 to set them ahead.

Reference will now be had to the remaining diagrams for a more complete description of the invention. A flat base plate 30 of stainless steel seats a rotor bearing 32, a fourth wheel bearing 34 and a third wheel bearing 36. A stator 38 and a stator 40 are secured to base plate 30 by welding or similar means and are fabricated from a material having a high permeability such as permalloy since coil 42 generates a magnetic flux. Coil 42 is comprised of a core 44, a coil supporting frame 46, 48 and a winding 50. As best shown in FIGS. **8*a* and 8*b*, the winding portion 44*a* and end portion 44*b* are coated with a 10 to 30 micron layer of resin film 45 made of polyimide resin. This resin film is formed by immersing the core 44 into polyamic acid solution to form a thin film layer on an entire surface thereof and heating the thin film layer by which the thin film layer has a heat-resistant and insulating property. A portion of the resin film formed on the core in which the insulating property is not required may be removed by a mechanical method or by photoetching. Thereafter, an electro-conductive paste such as silver paste is applied onto resin film 45 by screen printing, to form electro-conductive pattern 47. The supporting frame 46 is secured to the winding portion 44*a* of the core 44, whereupon the winding 50 is formed on the core 44 and the ends of the winding 50 are interconnected with the conductive pattern 47 on the resin film 45 by soldering. Subsequently, the winding 50 is covered by a protection tube 49. Coil supporting frames 46, 48 are made of a 100 micron layer of a metallic material and are similarly covered with the polyimide resin. There are two methods in which the resin may be applied: the core 44 and coil supporting frames 46, 48** are coated in one unit following their assembly or they are coated separately.

Figure 6:
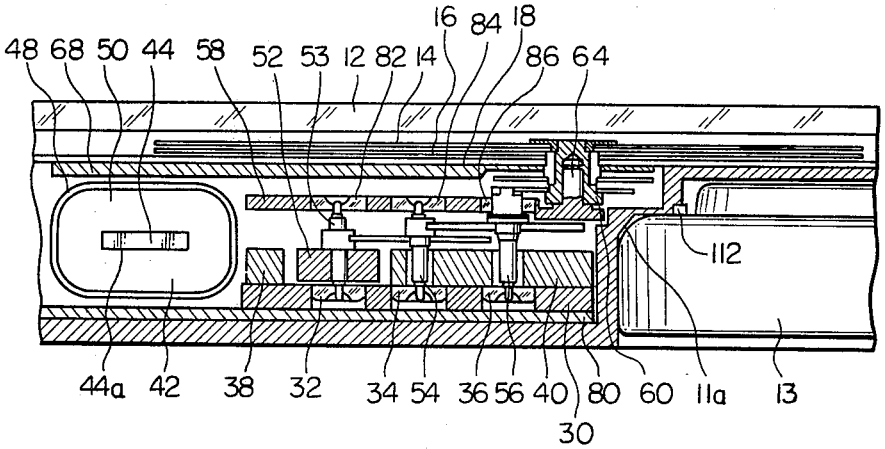
FIG. 6 is a cross sectional view of the movement shown in FIG. 4.

Stators 38, 40 surround a rotor 52 having a rotor magnet 54 which is a permanent magnet fabricated from samarium cobalt. Rotor 52 and a fourth wheel 54 as well as a third wheel 56 are axially supported between base plate 30 and a wheel train bridge 58. A second wheel 60 engaging with third wheel 56, and a minute wheel 62 engaging with second wheel 60 are loosely fitted to respective shafts 64, 66 projecting from wheel train bridge 58. In FIGS. 6 and 7, the axial movement of minute wheel 62 is limited by dial 18 disposed on an upper shielding plate 68 (designed to reduce the effects of external magnetic fields) which consists of a magnetic material. An hour wheel 70 in engagement with minute wheel 62 and supported due to the loosely fitting second wheel and pinion 60 is urged in the direction of wheel train bridge 58 by dial 18 and a dial washer 19, as shown in FIG. 7. A lower shielding plate 80 consisting of a magnetic material is disposed at the lower face of plate 30 so as to reduce the effects of external magnetic fields.

Figure 4:
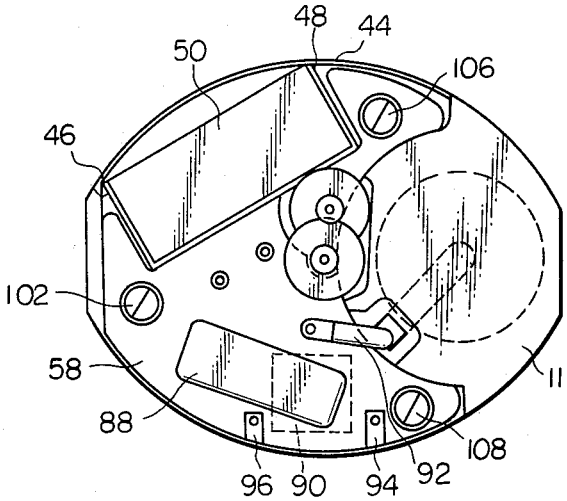
FIG. 4 is a plan view of a movement of the wristwatch in which a case for the watch is removed.
Figure 5:
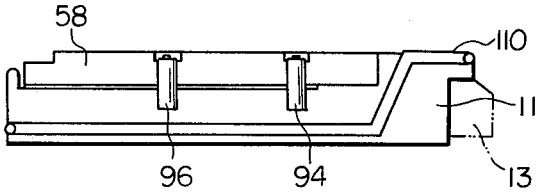
FIG. 5 is a side view of the movement shown in FIG. 4.
Figure 11:
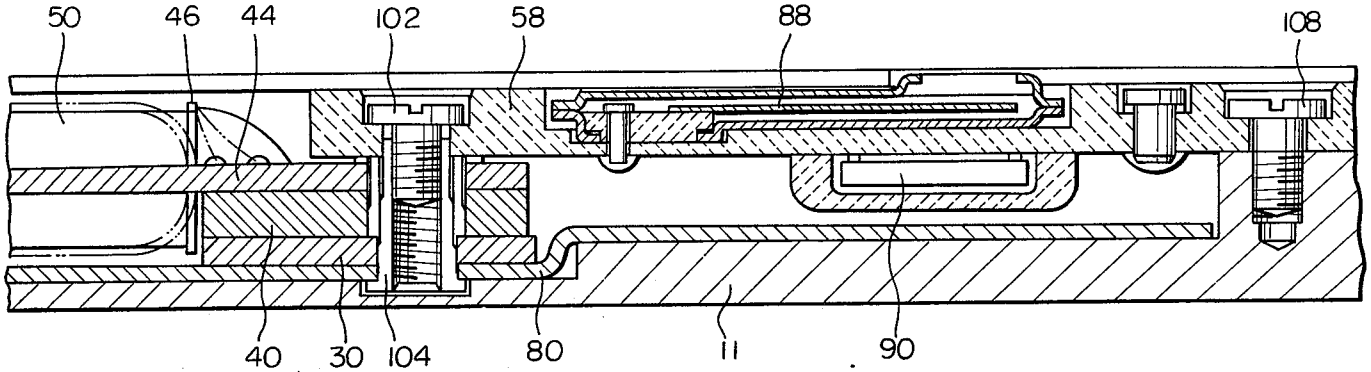
FIG. 11 is an enlarged cross sectional view of the movement showing the relationship between the driving coil of a stepping motor and other component parts.

In addition to shafts 64, 66 which mount second wheel 60 and minute wheel 62, wheel train bridge 58 also seats a rotor bearing 82, a fourth wheel bearing 84 and a third wheel bearing 86 which respectively provide axial support for rotor 52, fourth wheel 54 and third wheel 56. Turning now to FIGS. 4 and 11, a quartz crystal oscillator 88 is secured to the upper surface of wheel train bridge 58 serving as a circuit substrate and an IC chip 90 to the lower surface thereof. A negative terminal 92 is also disposed at the upper surface of wheel train bridge 58 and switch connection terminals 94, 96 extend from the upper surface of the bridge and down along its side.

Wheel train bridge 58 is comprised of stainless steel the surface of which at the bottom side is partially coated with a 25 micron layer of an insulating film of polyester sulphane. This insulating layer is provided with wiring either by vapor depositing a pattern and employing a plating method or by a screen printing method which makes use of a silver paste. The present embodiment adopts the latter of these two methods. This wiring permits completion of the connection between quartz oscillator 88 and IC chip 90.

The electrical connection to the stepping motor is accomplished by extending to the terminal end or edge of wheel train bridge 58 the wiring pattern 47 disposed on the insulating layer 45 (see FIG. 8A) which has been applied to core **44*a*. A piece of annular coil connecting rubber 100 shown in FIG. 8A is fabricated from a piece of electrically conductive rubber and is partially conductive in the vicinity of end portion 44*b* of bore 44. Coil connecting rubber 100 is sandwiched between wheel train bridge 58 and end portion 44*b* of core 44 and is capable of supplying an electric current to coil 42. At the same time screw 102 and tube 104 also serve to retain the various wheel trains while a screw 106 (see FIG. 4) and its associated tube (not shown) cooperate to fix base plate 30 and wheel train bridge 58. The distance between the base plate 30 and wheel train bridge 58 is determined by projecting portion 58*a* of the bridge. Indicated as 101** is a spacer made of an insulating material.

Figure 10:
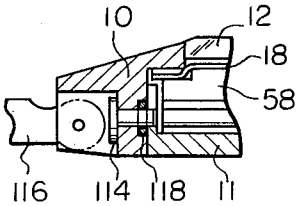
FIG. 10 is a cross sectional view of the movement showing the connection between the back cover and the watch case.
Figure 9:
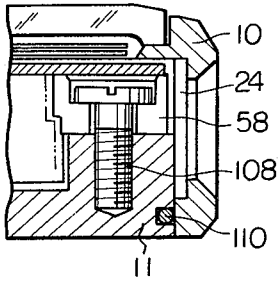

The wheel train section including plate 30 and wheel train bridge 58 assembled as described above is secured to back cover 11 by means of a screw 108. A packing 110 which is substantially circular in cross-section is laid in three dimensions about the outer circumference of back cover 11 and in cooperation with case 10 serves to prevent water, perspiration and dust from invading the watch. The bottom side of back cover 11 is provided with a recess **11*a* into which a battery 13 is inserted. The recess extends as far as case 10 and carries a battery seating ring 112. Battery 13 is secured to back cover 11 and case 10 by a flexible, thin, flexible battery cap spring 15 having three detents. The cap spring also functions to secure case 10 and back cover 11 to each other. At the same time case 10 and back cover 11 are also secured to each other by employing a case fastening pin 114 which is passed through both members and cannot be extracted unless band 116 is removed. A water-proof condition is afforded by a pin ring 118 made of rubber and installed within case 10, as can be seen in FIG. 10**.

Hour hand 16 is produced by forming a vapor deposited layer in the form of a watch hand on a transparent polyester disk and is fixed to hour wheel 70. Minute hand 14 is a polyester substrate on which a hand having a metallic appearance is formed by vapor deposition.

Both of these members due to their flexibility may easily slide upon the other.

In order to provide a slender profile for coil 42 the cross-section of core 44 is adapted so as to have a reduced longitudinal-transverse ratio which, in the present embodiment, is held to approximately 1/5. In conventional cores of this type it was usual practice to adopt a ratio ranging between 1 and 0.8. For any value below this the core 44 would be repeatedly subjected to stress due to the tensile force applied by a wire being wound upon it. This would lead to a deterioration in the permeability of the magnetic material and reduce the effectiveness of the motor. Since the stress encountered is chiefly the result of rotating core 44 during the winding operation, the present embodiment adopts a method in which the core is not rotated. For example, a toroidal winding machine was improved and utilized to perform the winding operation and this made it possible to greatly reduce the longitudinal-transverse ratio and provide a core thinner than those formerly available.

Figure 12:
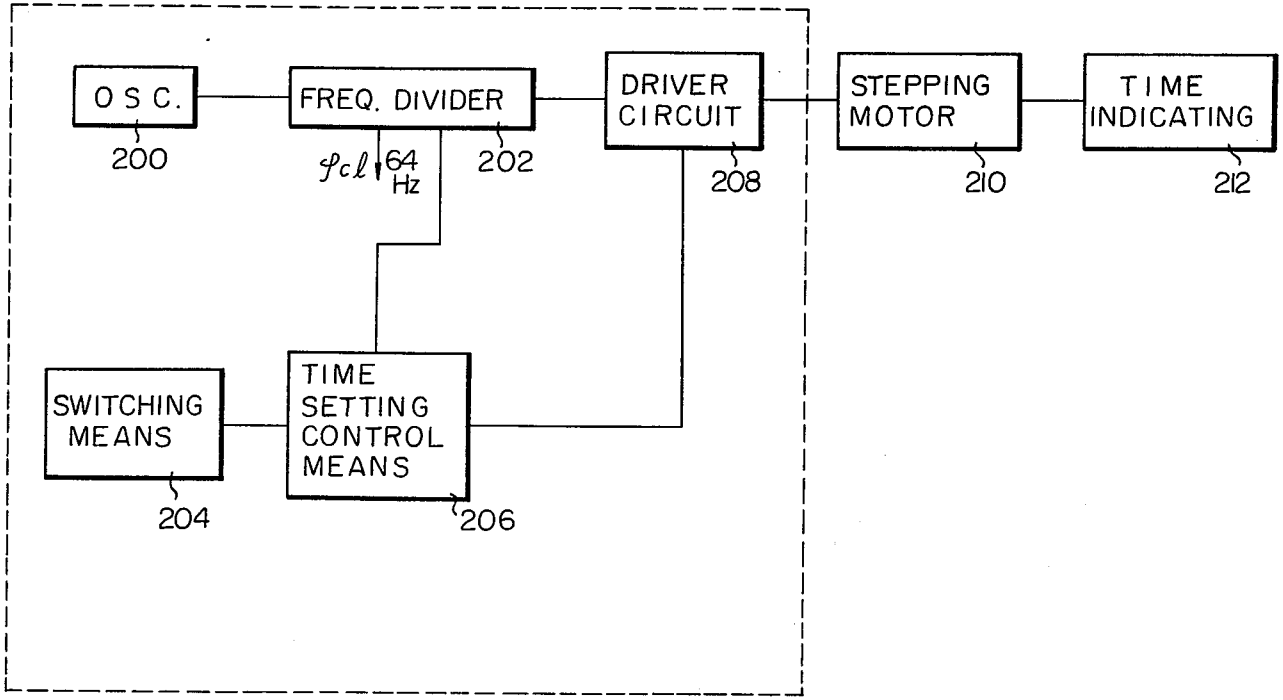
FIG. 12 is a block diagram of an electric circuitry for the wristwatch shown in FIG. 1.
Figure 13:
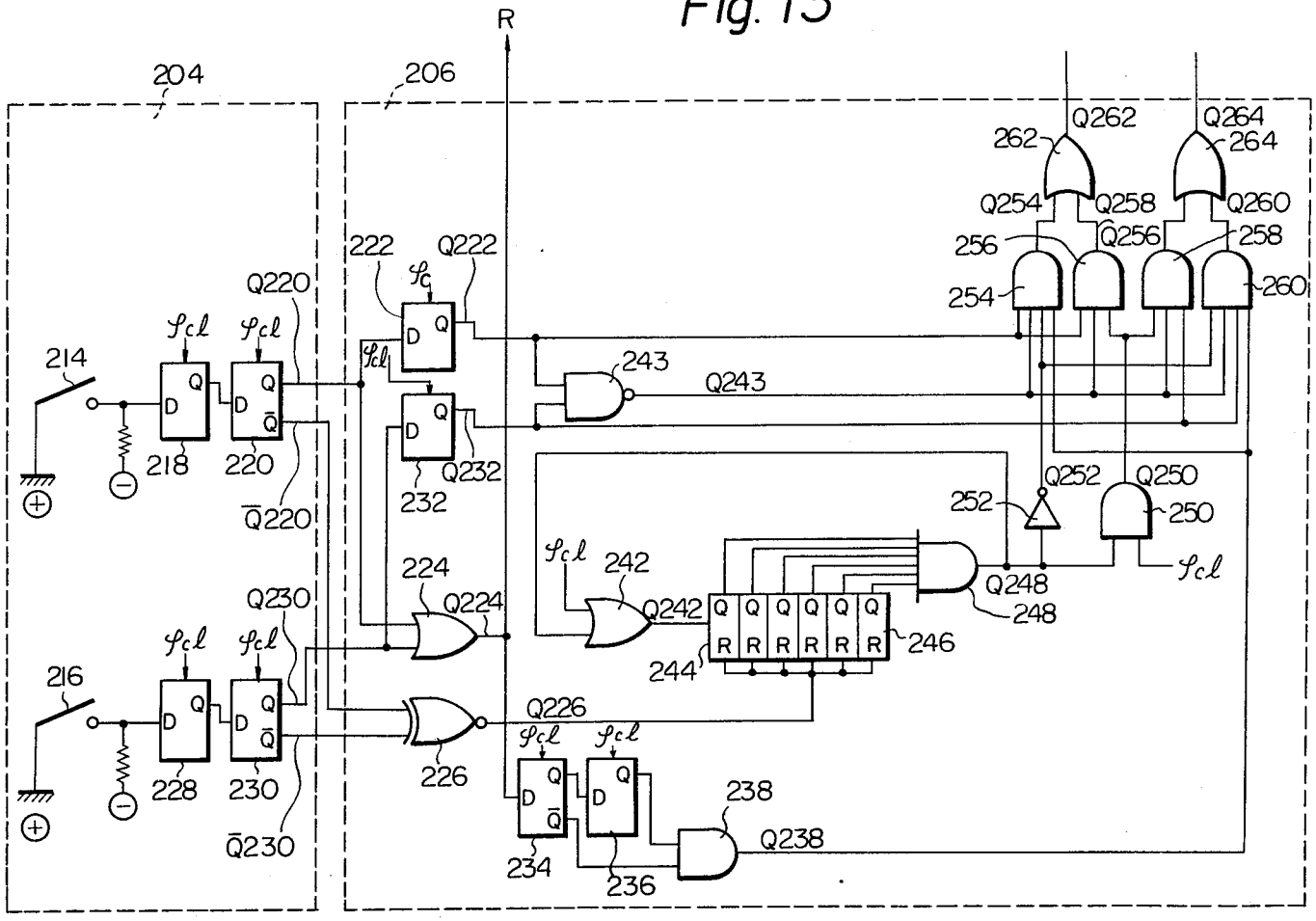
FIG. 13 is a detailed electric circuitry showing a switching means and a time setting control means forming part of the circuitry shown in FIG. 12.

For a description of the circuitry utilized in the present invention reference will now be had to FIGS. 12 through 14.

A 32768 Hz signal produced by an oscillator circuit 200 which includes a quartz oscillator is divided by a frequency divider 202. A 64 Hz clock pulse $\phi$Cl generated by the frequency divider 202 serves as a control signal for the circuits which comprise switching means 204 and time setting control means 206. A driver circuit 208 which includes a clockwise-counterclockwise decision circuit feeds a 1/10 Hz signal to a converter 210 which is a stepping motor and capable of rotating clockwise or counterclockwise. The stepping motor in turn drives a time indicating mechanism 212 through 10 seconds in response to the 1/10 Hz signal.

For a more detailed description of switching means 204 and time setting control means 206 reference will now be had to FIGS. 13 and 14.

Switching means 204 is provided with a switch 214 for clockwise rotation and a switch 216 for counterclockwise rotation. Closing switch 214 supplies an H logic level signal to flip-flop (FF) 218 whereby FF 218 and FF 220 produce noiseless signals Q 220 and $\overline{Q}$ 220. These signals are shown on timing chart of FIG. 14A. It should be understood that the same operation is obtained when switch 216 is closed. Signal Q 220 is supplied to FF 222 and OR gate 224, and signal $\overline{Q}$ 220 is applied to exclusive NOR gate 226. Signals associated with switch 216, namely signal Q 230 and signal $\overline{Q}$ 230, are produced, with signal Q 230 being applied to OR gate 224 and FF 232 and signal $\overline{Q}$ 230 being applied to exclusive NOR gate 226. Output signal Q 224 obtained from OR gate 224 is used to reset the stages which follow the flip-flop being employed in frequency divider 202 to produce the clock pulse $\phi$Cl. Signal Q 224 is also supplied to FF 234 which is adapted to produce a single pulse. At this point reference should be had to timing chart in FIG. 14B which also shows the signals obtained from FF 236 and AND gate 238. Signal Q 242 obtained from OR gate 242 is applied to FF 244 which, in combination with flip-flops through 246 and AND gate 248, produces a one second internal signal and then maintains its state one second thereafter, as can be appreciated from timing chart of FIG. 14C. Signal Q 248 is supplied to AND gate 250 which in turn produces a signal Q 250 applied to AND gate 256 and 258. In addition, signal Q 243 obtained from NAND gate 243 is supplied to AND gates 254, 256, 258 and 260.

Figure 14A:
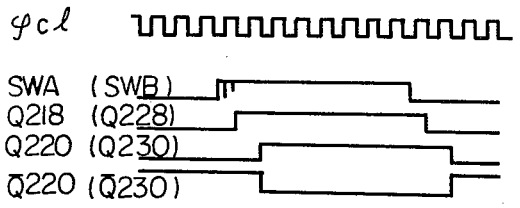
FIGS. 14A to 14F show waveform diagrams for the circuitry shown in FIG. 13.
Figure 14B:
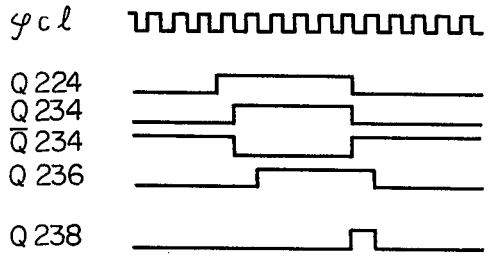
Figure 14C:
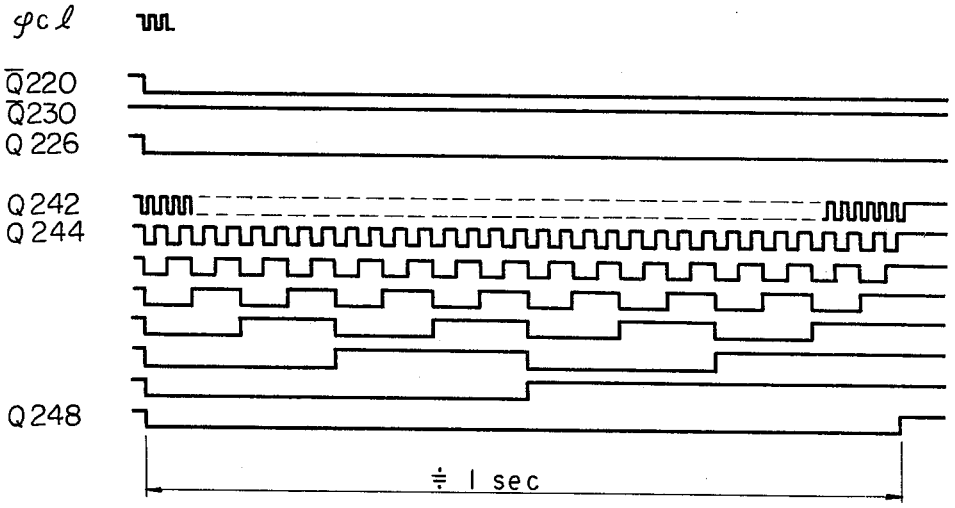
Figure 14D:
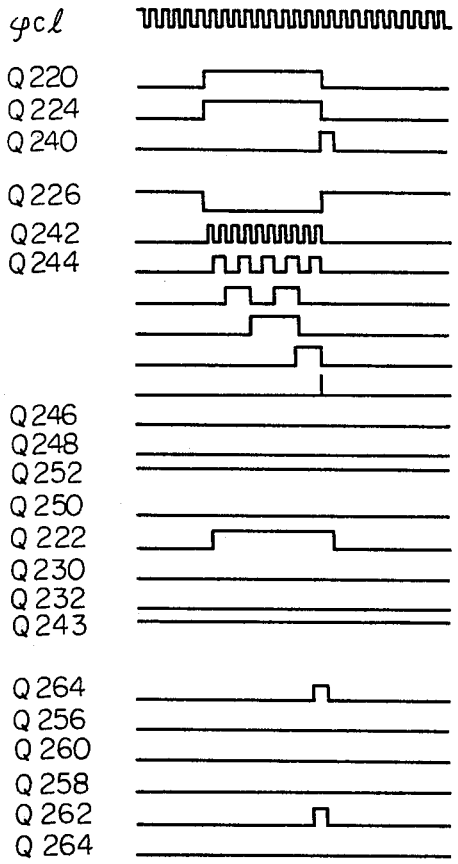
Figure 14E:
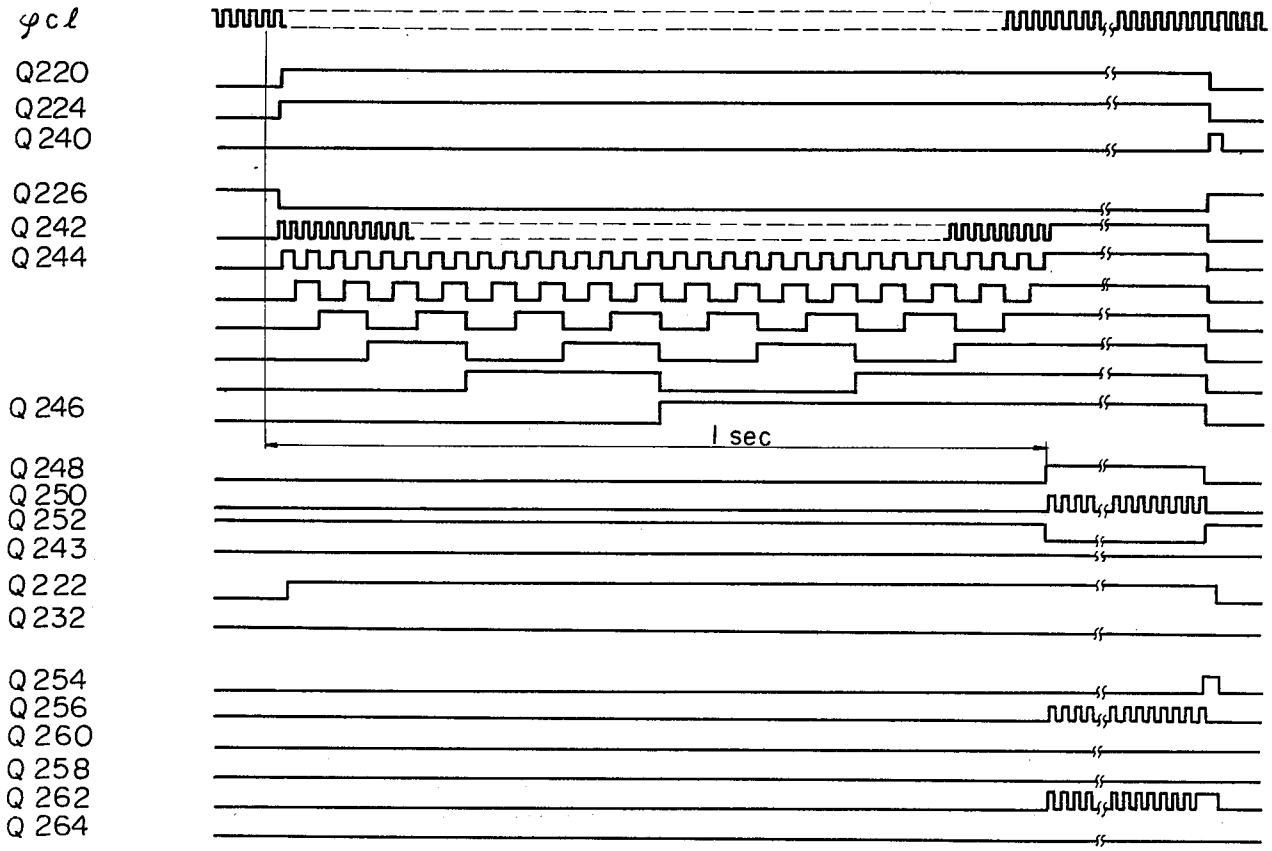
Figure 14F:
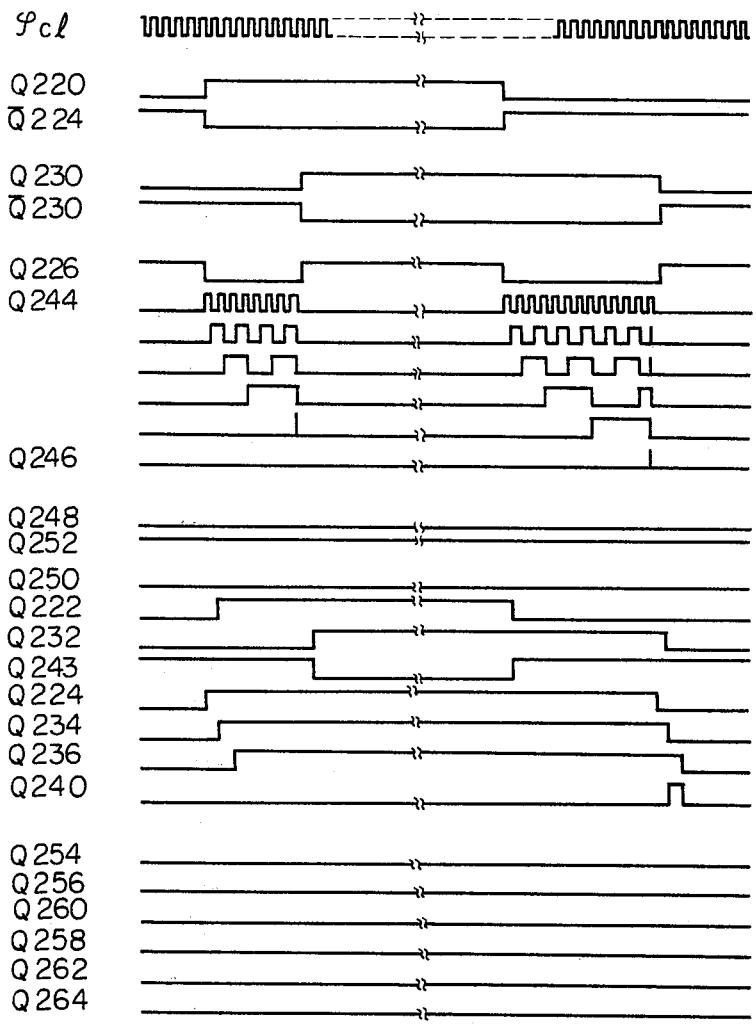

The method in which switching means 204 and time setting control means 206 are operated may be summarized in the following table:

| Switch 214 | Switch 216 | State | Time chart |
|---|---|---|---|
| ON(but switched OFF for intervals of less than 1 second) | OFF | Watch set 10 seconds ahead for each operation | FIG. 14D |
| ON(but switched OFF for intervals of 1 second or more) | OFF | Watch set ahead at a rapid rate of 11 minutes for each 1 second of operation | FIG. 14E |
| OFF | ON(but switched OFF for intervals of less than 1 second | Watch set back 10 seconds for each operation | |
| OFF | ON(but switched OFF for intervals of 1 second or more) | Watch set back at a rapid rate of 11 minutes for each 1 second of operation | |
| ON | ON | Watch is in the reset condition during this interval | FIG. 14F |
| OFF | OFF | Normal operation | |

When switch 216 is OFF and switch 214 ON (but switched OFF for intervals of less than one second), a single pulse shown in FIG. 14D is produced when switch 214 is released. This pulse is supplied from OR gate 262 to driver circuit 208 as a signal Q 262. The signal passed by OR gate 262 is utilized in driver circuit 208 as a signal to advance the time indicating mechanism.

When switch 214 is OFF and switch 216 ON (but switched OFF for intervals of 1 second or more), a single pulse is produced by OR gate 264. In this case waveforms analogous to those shown in FIG. 14D are the result. The signal passed by OR gate 264 is utilized in driver circuit 208 to retard the time indicating mechanism.

Next, if switch 214 is switched ON for more than 1 second and switch 216 is in the OFF state, the waveforms shown in FIG. 14E are produced. In this case OR gate 262 produced a signal Q 262 approximately one second after switch 214 is switched to the ON state. As a result, the hands of the timepiece are set ahead at a rapid rate of approximately 11 minute over an interval of one second. If switch 216 is switched ON for more than one second and switch 214 is in the OFF state, waveforms analogous to those shown in FIG. 14E are the result. Thus, approximately one second after switch 216 is switched ON, OR gate 264 produces a signal Q 264 which has the same waveform as signal Q 262 shown in FIG. 14E. Accordingly, the hands of the timepiece are set back at a rapid rate of approximately 11 minutes over each interval of one second.

FIG. 14F shows the timing chart for a case in which both switch 214 and 216 are depressed. Here, the signals supplied by OR gates 262 and 264 are at an L logic level and signal Q 224 resets the flip-flop states which follow the flip-flop being employed in frequency divider 202 to produce the 64 Hz signal. The timepiece is thus halted and held in the non-operative state.

Figure 15:
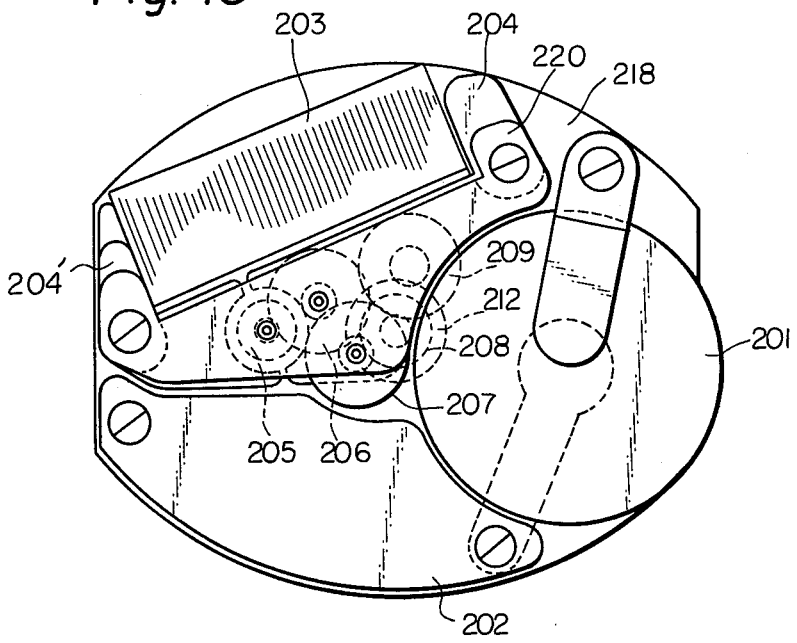
FIG. 15 is a plan view of another preferred embodiment of a movement structure according to the present invention.
Figure 16:
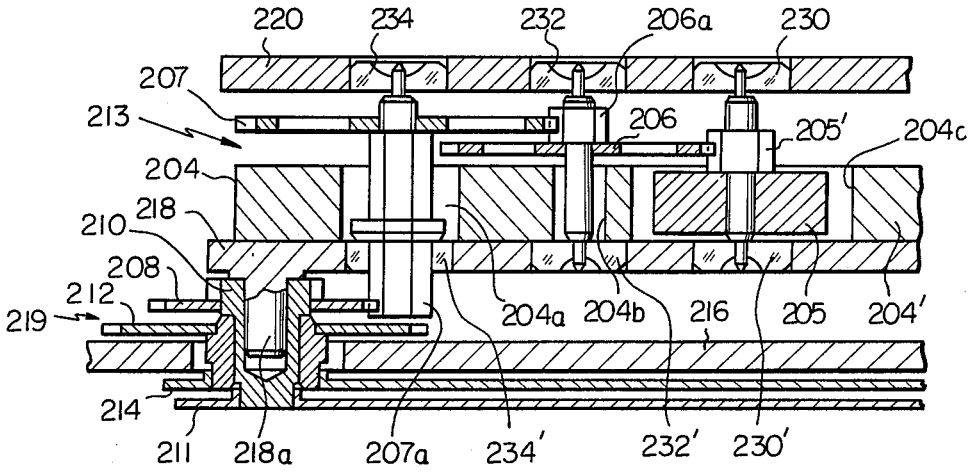
FIG. 16 is a cross sectional view of the movement structure shown in FIG. 15.

FIGS. 15 and 16 show another preferred embodiment of a movement structure of an electronic wristwatch according to the present invention. In FIGS. 15 and 16, reference numerals 201 denotes a battery, 202 a circuit board mounting thereon a quartz crystal vibrator and associated circuit components (not shown), 203 a driving coil of an electro-mechanical transducer having a rotor 205 provided with a pinion 205', and 204, 204' stators electromagnetically connected to a core on which the driving coil 203 is wound for rotating the rotor 205. The rotor pinion 205' meshes with a first reduction gear 206 having a pinion **206*a* with which a second reduction gear 207 meshes. The stators 204, 204' are mounted on one side of wheel train bridge 218 and has a plurality of bores 204*a*, 204*b* and 204*c*, which accommodate respective portions of the second reduction gear 207, first reduction gear 204*b* and rotor 205, respectively. A first wheel train 213 constituted by the first reduction gear 206 and second reduction gear 207 is operatively disposed between a base plate 220 and the wheel train bridge 218 and rotatably supported by bearings 230, 230', bearings 232, 232', and bearings 234, 234', respectively, with the bearing 230, 232, and 234 being supported by the base plate 220 while the bearing 230', 232', and 234' are supported by the wheel train bridge 204. The first wheel train 213 is drivably connected to the rotor pinion 205' to receive a driving power therefrom. The second reduction gear 207 has on its lower end provided with a reduction gear pinion 207*a* serving as an engaging means having a first portion in engagement with and rotatably supported by the bearing 234' and a second portion meshing with a center wheel 208. The second portion of the engaging means 207*a* has an outer diameter smaller than an inner diameter of bearing 234'. The center wheel 208, a minutes wheel 209, and an hours wheel 212 form a second wheel train 219 which is disposed between wheel train bridge 218 and time dial 216**.

Figure 17:
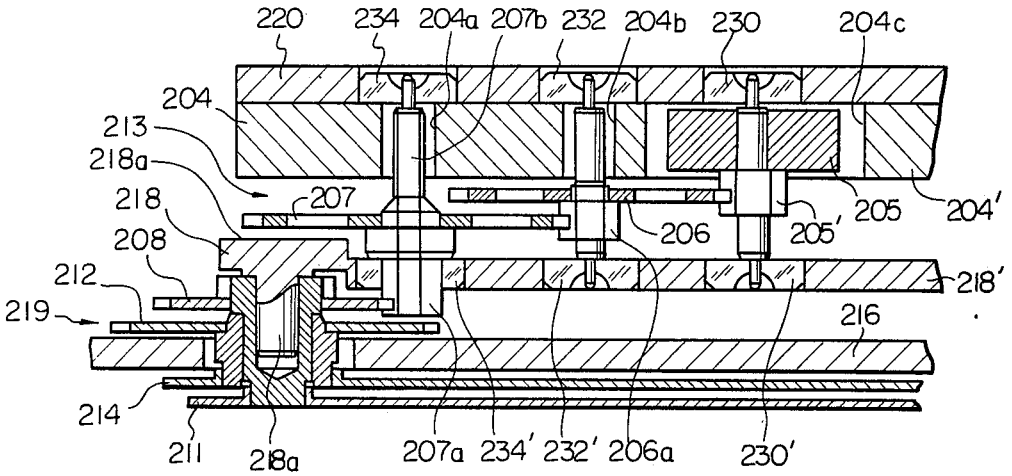
FIG. 17 is a cross sectional view of another preferred embodiment of a movement structure shown in FIG. 16.

FIG. 17 shows a modification of the movement structure shown in FIG. 16, with the corresponding or like conponents bearing the same reference numerals as those used in FIG. 16. The movement structure of FIG. 17 is identical to that of FIG. 16 except that stators 204, 204' are secured to the base plate 220 and the first wheel train 213 composed of the first reduction gear 206 and the second reduction gear 207 is located in a space between the stators 204, 204' and the wheel train bridge 218. A shaft portion of the second reduction gear 207 has a small diameter so that the bore **204*a* of the stator 204 can be minimized in diameter to prevent deterioration in operating characteristic of the stator 204 that would otherwise be caused by providing the bore 204*a* of a larger diameter as shown in FIG. 16. In the embodiment of FIG. 17, the wheel train bridge 218 has a lower level portion 218' which is lower in level from a surface 218*a* and which extends toward time dial 216, thereby reducing the thickness of the movement structure. The stators 204, 204' may be secured to the base plate 220 by spot welding, thereby providing an easy assembly of the movement. In addition, the base plate 220 may be reduced in size to such extent that the base plate 220 provides an area to support the bearings 230, 232 and 234. The arrangement of FIG. 17 makes it possible to efficiently utilize the space in the movement structure and provide easy assembling due to the provision of a single piece of the base plate and the stators secured thereto. The base plate 220 also serves as a connecting member which interconnects the stators 204 and 204' to one another. In addition to those features, a slender, compact timepiece can be attained due to the fact that: the wheel train is interposed between the stators and the wheel train bridge, the wheel train bridge 218 has a lower level portion on which bearings for the wheel train are supported, and the second reduction gear 207 has its engaging portion 207*a* directly engaged with the bearing 234' of the wheel train bridge 218** for thereby eliminating a lower end shaft to engage with the corresponding bearing.

Figure 18:
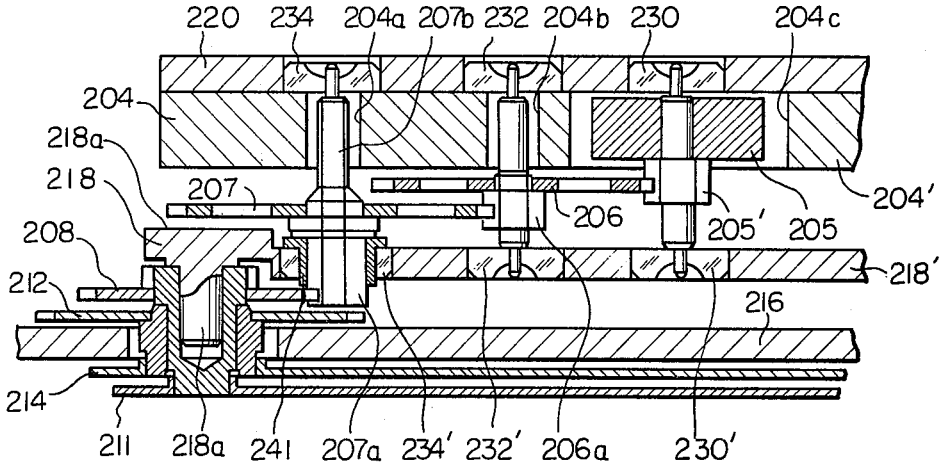
FIG. 18 is a cross sectional view of the structure shown in FIG. 17.

While, in the embodiments of FIGS. 16 and 17, the pinion **207*a* has been shown and described as directly engaging the bearing 234', a bush member 241 may be tightly fitted over the pinion 207*a* and engage with the bearing 234' in a manner as shown in FIG. 18**.

Figure 19:
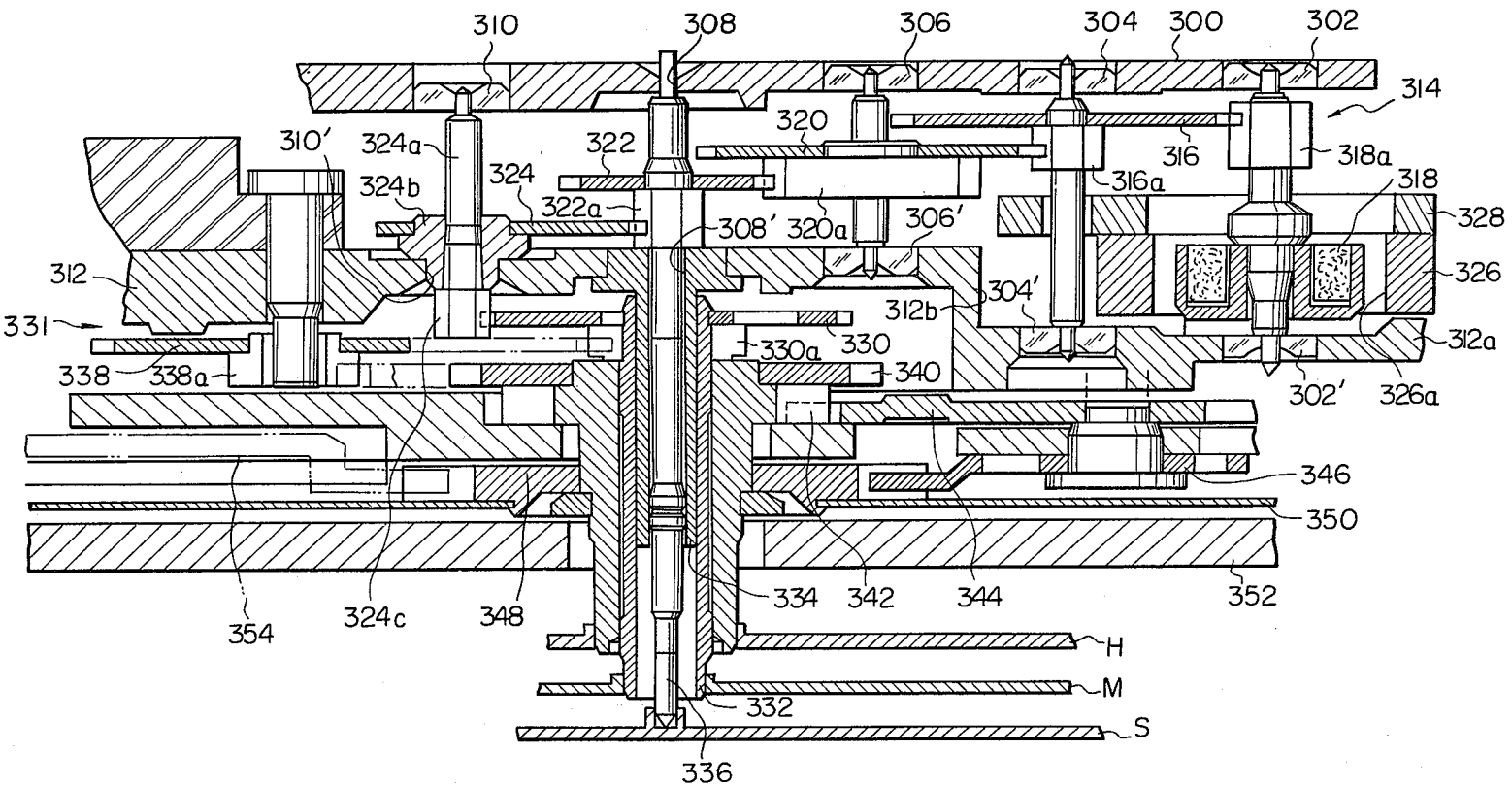
FIG. 19 is a cross sectional view of another preferred embodiment of a movement structure according to the present invention.

FIG. 19 shows another preferred embodiment of a movement structure according to the present invention. The movement structure is shown as comprising a base plate 300 provided with bearings 302, 304, 306 and 310 and bearing hole 308, and a wheel train bridge 312 provided with bearings 302', 304', and bearing hole 310'. The base plate 300 and the wheel train bridge 312 is spaced from one another to provide a gap therebetween in which a first wheel train 314 is disposed. The first wheel train 314 is shown to include a first reduction gear 316 engaging with a rotor pinion **318*a* of a rotor 318 to receive a driving power therefrom, a second reduction gear and pinion 320 engaging with pinion 316*a* of the first reduction gear and pinion 316, a fourth wheel and pinion 322 engaging with pinion 320*a* of the second reduction gear and pinion 320, and a third wheel and pinion 324 engaging with pinion 322*a* of the fourth wheel and pinion 322. A stator 326 of a stepping motor is disposed in a recess 312*b* of the wheel train bridge and supported by a yoke 328 supported by the wheel train bridge 312. The stator 326 has an air gap 326*a* in which the rotor 318 is operatively disposed. The wheel train bridge 312 has a lower level portion 312*a* by which the bearings 302' and 304' are supported. The third wheel and pinion 324 comprises a shaft 324*a* having its upper end supported by the bearing 310, an intermediate portion provided with a boss portion 324*b* having its lower portion engaging with the bearing hole 310' provided in the wheel train bridge 312, and a lower end provided with a pinion 324*c* engaging with a center wheel 330 connected to a center wheel shaft 332 carrying a minutes hand M. The center wheel shaft 332 is rotatably supported by a central shaft 334 having its upper end supported by the wheel train bridge 312. The central shaft 334 has a central bore 308' through which a seconds shaft 336 connected to the fourth wheel and pinion 322 axially extends and actuates a seconds hand S. The center wheel 330 has a pinion 330*a* engaging with a minutes wheel 338 which has a pinion 338*a* engaging with an hours wheel 340. The center wheel 330, minutes wheel 338 and hours wheel 340 form a second wheel train 331 which is disposed between the wheel train bridge 312 and time dial 352. The hours wheel 340 actuates an hours hand H. A gear wheel 342 is rotatable with the hours wheel and meshes with a gear 344. The gear 344 is connected to a gear 346 which rotates a date wheel 348 by which a date dial 350 is rotated. Reference numeral 354 denotes a correcting lever for rotating the date dial 350**.

The features of the present invention as herein described may be summarized as follows:

(1) The plate utilized in the timepiece is flat and also serves as the supporting plate for the stators. This is made possible by adopting a method of assembly in which components are stacked. Thus by departing from the conventional method of assembly the present invention affords a slender, compact timepiece and one in which the plate is capable of being readily manufactured.

(2) The wheel train bridge is adopted as the substrate for the printed circuitry. This is made possible by developments in IC techniques and by skills acquired in the insulating of metallic substrates. Wiring and interconnections can be readily accomplished while soldered joints and screws are greatly reduced in number.

(3) The shafts which support the hour hand, minute hand and minute wheel are mounted to the wheel train bridge. This is made possible by adopting a method of assembly not conventionally employed and is advantageous in that the number of parts can be reduced.

(4) The wheel pinion (in the present invention the third wheel pinion) passing through the wheel train bridge is itself supported by a bearing, a system which is not found conventionally. According to the present invention the wheel pinion is itself provided with a step to limit its travel in the direction of thrust. Since the step is positioned at the outer periphery of the wheel pinion away from its meshing face there is no harmful effect upon the meshing efficiency. The number of teeth for a pinion wheel which affords such a step is preferably 8 or more but 7 teeth will also suffice. This provides an excellent wheel train arrangement and one which is readily assembled.

(5) Adopting a longitudinal-transverse ratio of ½ for the coil core cross-section provides a flat coil which allows the timepiece to be greatly reduced in thickness. Such a cross-section is possible since the core is not rotated when wound with a wire filament. Undue stress is thus not applied to the core which prevents a deterioration in its permeability.

(6) Thin, flexible disks are employed as the hands of the timepiece. This is possible because unlike conventional metallic hands the present invention makes use of hands which are fabricated from a polyester material. This provides an extremely slender timepiece since both hands are permitted to slide upon each other or upon the dial. In the present embodiment a vapor deposit is applied in the form of a hand on a transparent disk which is then used.

(7) The battery can be readily replaced from outside the timepiece. To this end there are employed a thin, flexible battery cap spring and a battery seating ring, the former providing support for the battery and the latter assuring a water- and dust-proof condition. A separate battery cover is thus unnecessary which allow a further reduction in thickness and affords handling ease.

(8) Either the dial or upper shielding plate are seated in the back cover. This affords a slender timepiece and one in which the section which houses the movement and the section which houses the battery are completely separate. This contributes to the effectiveness of the water-proofing and dust-proofing characteristics.

(9) The back cover provides support for flexure of the wheel train bridge. By adopting a design in which there is a suitable gap between the wheel train bridge and back cover external forces which may be applied to the wheel train bridge are born by the back cover. Accordingly, the wheel train bridge can be partially reduced in thickness which contributes to a thinner timepiece. Formerly, although there were methods according to which external forces were born by the plate of the timepiece, these methods necessitated a complicated plate structure and were thus inconvenient. The present invention avoids this and provides a simplified plate structure by making use of a back cover which extends up to the vicinity of the dial.

(10) The timepiece movement is directly fastened to the back cover by means of a screw. The movement is secured to the case in conventional timepiece by making use of intermediate frames, springs and the like, all of which are dispensed with according to the present invention. This at once provides a compact timepiece and one in which the movement is reliably secured to the case.

(11) The battery partially extends beyond the rim of the back cover and is protected by the case. Conventionally, this feature in which the battery projects beyond the back cover does not exist; consequently, the overall size of the timepiece in comparison to the size of the movement housed within it is disproportionately large. The present invention was devised from the standpoint that the battery need not be confined within the circumference of the back cover.

(12) One way to achieve the feture outlined in (11) is to insert and three-dimensionally arrange a packing between the case and back cover in order to guarantee a water- and dust-proof condition.

(13) The battery cap spring maintains the battery and at the same time joins the case to the back cover. Means for joining the case and back cover can thus be simplified, and complicated joining means omitted.

(14) The insertion of a pin is adopted as one way of joining the case and back cover, and the pin cannot be removed unless the band is detached. Using a pin to join these parts allows ease of construction and assembly and provides outstanding effects in cooperation with the features outlined in (10) and (13).

What is claimed is:

1. A movement structure for an electronic timepiece having a stepping motor and time indicating hands driven by said stepping motor, comprising:

a time dial;

a wheel train bridge disposed in spaced relationship with respect to said time dial;

a base plate spaced from said wheel train bridge;

a rotor forming part of said stepping motor and rotatably supported between said wheel train bridge and said base plate, said rotor having a rotor pinion;

a first reduction gear rotatably supported between said wheel train bridge and said base plate, said first reduction gear meshing said rotor pinion of said rotor and having a pinion;

a second reduction gear disposed between said wheel train bridge and said base plate and meshing said pinion of said first reduction gear, said second reduction gear being mounted on a shaft having its lower end provided with a reduction gear pinion directly and rotatably supported by said wheel train bridge;

a center wheel disposed between said wheel train bridge and said time dial and meshing said reduction gear pinion of said second reduction gear, said center wheel driving said indicating hands.

2. A movement structure according to claim 1, in which said stepping motor comprises stators for energizing said rotor.

3. A movement structure according to claim 2, in which said stators are secured to said wheel train bridge.

4. A movement structure according to claim 2, in which said stators are secured to said base plate.

5. A movement structure according to claim 1, in which said wheel train bridge has a bearing portion.

6. A movement structure according to claim 5, in which said pinion has an outer diameter smaller than an inner diameter of said bearing portion.

7. A movement structure according to claim 5, further comprising a sleeve member tightly fitted to an outer surface of said pinion and rotatably supported by said bearing portion of said wheel train bridge.

8. A movement structure according to claim 1, in which said wheel train bridge carries thereon an integrated circuit chip incorporating an oscillator circuit and a frequency divider, and an oscillator vibrator.

9. A movement structure according to claim 1, in which said stepping motor comprises a core supported by said base plate, and a driving coil wound around said core, said core having a cross section in which the longitudinal-transverse ratio is selected to be less than ½.

10. A movement structure according to claim 1, in which said electronic timepiece comprises a watch case and a back secured thereto, said back cover having at its bottom side formed with a recess to accommodate a battery.

11. A movement structure according to claim 10, further comprising a retaining spring secured to said back cover to retain said battery in place.

12. A movement structure according to claim 10, further comprising a first shielding plate facing said wheel train bridge, and a second shielding plate secured to said base plate, said first shielding plate being supported by said back cover.

13. A movement structure according to claim 10, in which said movement structure is directly connected to said back cover by screws.

14. A movement structure according to claim 10, further comprising sealding means disposed between said watch case and said back cover.

15. A movement structure for an electronic timepiece having a stepping motor and time indicating hands driven by said stepping motor, comprising:

a time dial;

a wheel train bridge disposed in spaced relationship with respect to said time dial;

a base plate spaced from said wheel train bridge;

a rotor forming part of said stepping motor and rotatably supported between said wheel train bridge and said base plate, said rotor having a rotor pinion;

a first reduction gear rotatably supported between said wheel train bridge and said base plate, said first reduction gear meshing said rotor pinion of said first rotor and having a first pinion;

a second reduction gear rotatably supported between said wheel train bridge and said base plate, said second reduction gear meshing said first pinion of said first reduction gear and having a second pinion;

a fourth wheel rotatably supported between said wheel train bridge and said base plate, said fourth wheel meshing said second pinion of said second reduction gear and having a third pinion;

a third wheel disposed between said wheel train bridge and said base plate and meshing said third pinion of said fourth wheel, said third wheel including a shaft having its upper end rotatably supported by said base plate, an intermediate portion provided with a boss portion having its lower portion directly and rotatably supported by said wheel train bridge, and a lower end provided with a pinion;

a center wheel disposed between said wheel train bridge and said time dial and meshing said pinion of said third wheel, said center wheel driving said indicating hands.

* * * * *